US006874749B2

(12) United States Patent
Wells

(10) Patent No.: US 6,874,749 B2
(45) Date of Patent: Apr. 5, 2005

(54) CONSTRUCTION FORM SYSTEM

(76) Inventor: Joel Wells, 9510 Pine Knob Rd., Clarkston, MI (US) 48348

( * ) Notice: Subject to any disclaimer, the term of this patent is extended or adjusted under 35 U.S.C. 154(b) by 0 days.

(21) Appl. No.: 10/119,608

(22) Filed: Apr. 10, 2002

(65) Prior Publication Data

US 2003/0193007 A1 Oct. 16, 2003

(51) Int. Cl.[7] ..... E04G 9/02
(52) U.S. Cl. ..... 249/191; 249/196
(58) Field of Search ..... 249/47, 191, 192, 249/196; 52/800.1, 800.11, 793.1, 793.11, 784.14, 784.15, 797.1, 796.12

(56) References Cited

U.S. PATENT DOCUMENTS

| | | | | |
|---|---|---|---|---|
| 3,381,929 A | | 5/1968 | Bancker | |
| 4,116,415 A | | 9/1978 | Ward | |
| 4,150,808 A | | 4/1979 | Sawyer | |
| 4,181,286 A | | 1/1980 | Van Doren | |
| 4,283,449 A | | 8/1981 | Damminger | |
| 4,463,926 A | | 8/1984 | Bomberger | |
| 4,832,308 A | | 5/1989 | Slonimsky et al. | |
| 4,931,340 A | * | 6/1990 | Baba et al. | 52/793.1 |
| 5,074,517 A | | 12/1991 | Scott | |
| 5,087,511 A | | 2/1992 | Locey | |
| 5,098,059 A | | 3/1992 | Sawyer | |
| 5,302,099 A | | 4/1994 | Serafini | |
| 5,431,366 A | | 7/1995 | Matsumoto et al. | |
| 5,792,552 A | | 8/1998 | Langkamp et al. | |
| 5,855,808 A | | 1/1999 | DiBerardino | |

FOREIGN PATENT DOCUMENTS

| | | | | |
|---|---|---|---|---|
| CA | 893956 | * | 2/1972 | 52/800.11 |
| IT | 432795 | * | 1/1949 | 52/797.1 |

* cited by examiner

*Primary Examiner*—Michael Safavi

(57) ABSTRACT

A construction form system comprising a plurality of construction forms each including a form sheet having a face side, a back side and a support section defined there between and a connection edge, a side frame for supporting the form sheet, the side frame having a face section and a wall section wherein the face section cooperatively mates with the connection edge of the form sheet to provide a form surface, at least one ladder extending from a side of the side frame to an opposite side of the side frame, and a plurality of brackets attached to the side frame adapted to support the form sheet and wherein the form sheet is free floating within the side frame to protect the form sheet from damage in operation such that at least one of the brackets is used to connect one side frame of one construction form to another side frame of another construction form.

6 Claims, 6 Drawing Sheets

CONSTRUCTION FORM SYSTEM

TECHNICAL FIELD

This invention relates to a construction form system for poured wall applications and more particularly to a light-weight composite panel form system for poured wall applications.

BACKGROUND ART

Concrete poured wall foundations are becoming increasing popular in new construction practices. Poured walls provide certain well known advantages over concrete block construction. Removable forms are now frequently being used to form poured concrete walls of basements or buildings. Such forms are frequently used repeatedly and must withstand substantial wear and abuse during handling and shipping. Concrete construction forms must also be very rigid to avoid bending when subjected to static pressure generated by the concrete when it is poured between the forms.

To accommodate the requirements that such forms be durable and resistant to bending, prior art forms have generally been constructed from steel, iron, wood or aluminum. Such forms have the disadvantage that they are relatively heavy and difficult to manipulate. Consequently, handling of the forms becomes time consuming and labor intensive, and concrete casting comprises a substantial part of the cost of building construction. Additionally, most prior art systems require some form of forming oil or lubricant which decreases the tendency of the form face sheet to stick to the poured concrete wall. Forming oil or lubricant management is often a disadvantage to the use of poured wall foundations.

Current concrete forms are also expensive to manufacture as they require multiple parts such as many as seven to ten ladder supports which are required to support the concrete form. Further, current concrete form designs are not conducive to maintenance or repair as they do have include interchangeable long lasting parts. If a side rail or ladder is broken or unfit for use, the entire concrete form is discarded.

U.S. Pat. No. 4,150,808 to Robert D. Sawyer discloses a removable form for use in pouring concrete walls, the form being comprised of a high strength, impact resistant, light weight material and being constructed to provide thermal insulation of concrete poured between two of the forms. The forms are each comprised of a face plate backed by an insulative support structure. The insulative support structure has a honeycomb construction filled with an insulative material, the honeycomb construction providing strength to the insulative support structure to prevent bending or distortion. A supporting frame is further provided as a structural supporting backing for the insulative support section to increase its resistance to bending.

DISCLOSURE OF THE INVENTION

It is a principal object of the present invention to provide a construction form which is significantly lighter than present designs.

It is a further object of the present invention to provide a construction form which requires less manufacturing time and labor to produce.

It is still another object of the present invention to provide a construction forming system which allows for wider forms to be used thereby increasing the efficiency of the construction forming process.

It is yet another object of the present invention to provide a construction forming system, which is non-corrosive and has a longer field use period than present designs.

Yet still further, it is an object of the present invention to provide construction forming system, which includes interchangeable parts thereby decreasing the cost of replacement parts and also allowing for a greater degree of flexibility in construction processes.

Yet another object of the present invention is to provide construction forming system significantly resists undesirable bowing in normal field use.

Still further, it is an object of the present invention to provide construction forming system which does not require the use of forming oil thereby decreasing costs, improving efficiency and decreasing environmental concerns.

It is still a further object of the present invention to provide a free floating form sheet which is not fastened directly to the side frame via any fasteners to protect the form sheet from damage in operation.

In carrying out these and other objects, features and advantages of the present invention, there is provided a construction form comprising a form sheet having a face side, a back side and a support section defined there between and a connection edge; and a side frame for supporting the form sheet, the side frame having a face section and a wall section wherein the face section cooperatively mates with the connection edge of the form sheet to provide a form surface.

In a preferred embodiment of the present invention the form sheet is a composite form sheet, the face side is a polymeric face sheet, the support section is a flexible honeycomb material and the connection edge is a polymeric material and the side frame face section is metal and includes a face side and a support side and the form sheet includes a recessed perimeter area adapted to mate with the face side of the side frame such that the face side of the side frame and face side of the form sheet when operatively connected form a flush surface.

In a preferred embodiment of the construction form system of the present invention, the construction form system comprises a form sheet having a face side, a back side and a support section defined there between and a connection edge; a side frame for supporting the form sheet, the side frame having a face section and a wall section wherein the face section cooperatively mates with the connection edge of the form sheet to provide a form surface, at least one ladder for connecting one side frame to another adjacent side frame, a plurality of brackets attached to the side frame wherein the form sheet is free floating within the side frame to protect the form sheet from damage in operation.

In a preferred embodiment of the construction form sheet of the present invention, the construction form sheet comprises a face sheet manufactured from a polymeric material, a back sheet; and a honeycomb support sheet located between the face sheet and the back sheet, the honeycomb support sheet including a connection edge disposed substantially along the perimeter of the form sheet, wherein the honeycomb support sheet is manufactured from a thermoplastic elastomer and the face sheet and back sheet are permanently glued to the honeycomb support sheet.

The above objects and other objects, features and advantages of the present invention are readily apparent from the following detailed description of the best mode for carrying out the invention when taken in connection with the accompanying drawings.

BEST MODE FOR CARRYING OUT THE INVENTION

Figure 1:
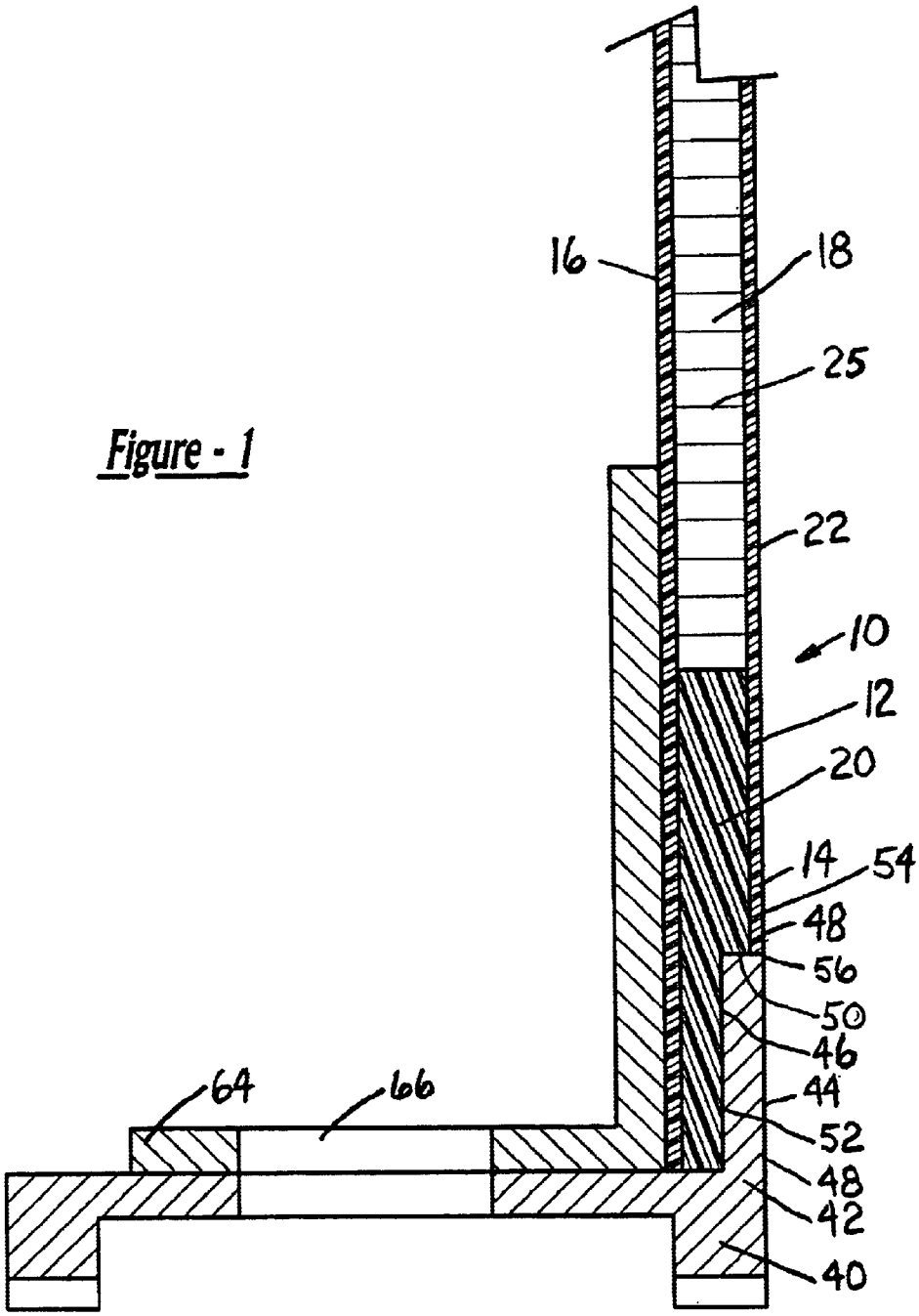
FIG. 1 is a partial cross sectional view of the construction form of the present invention.
Figure 3:
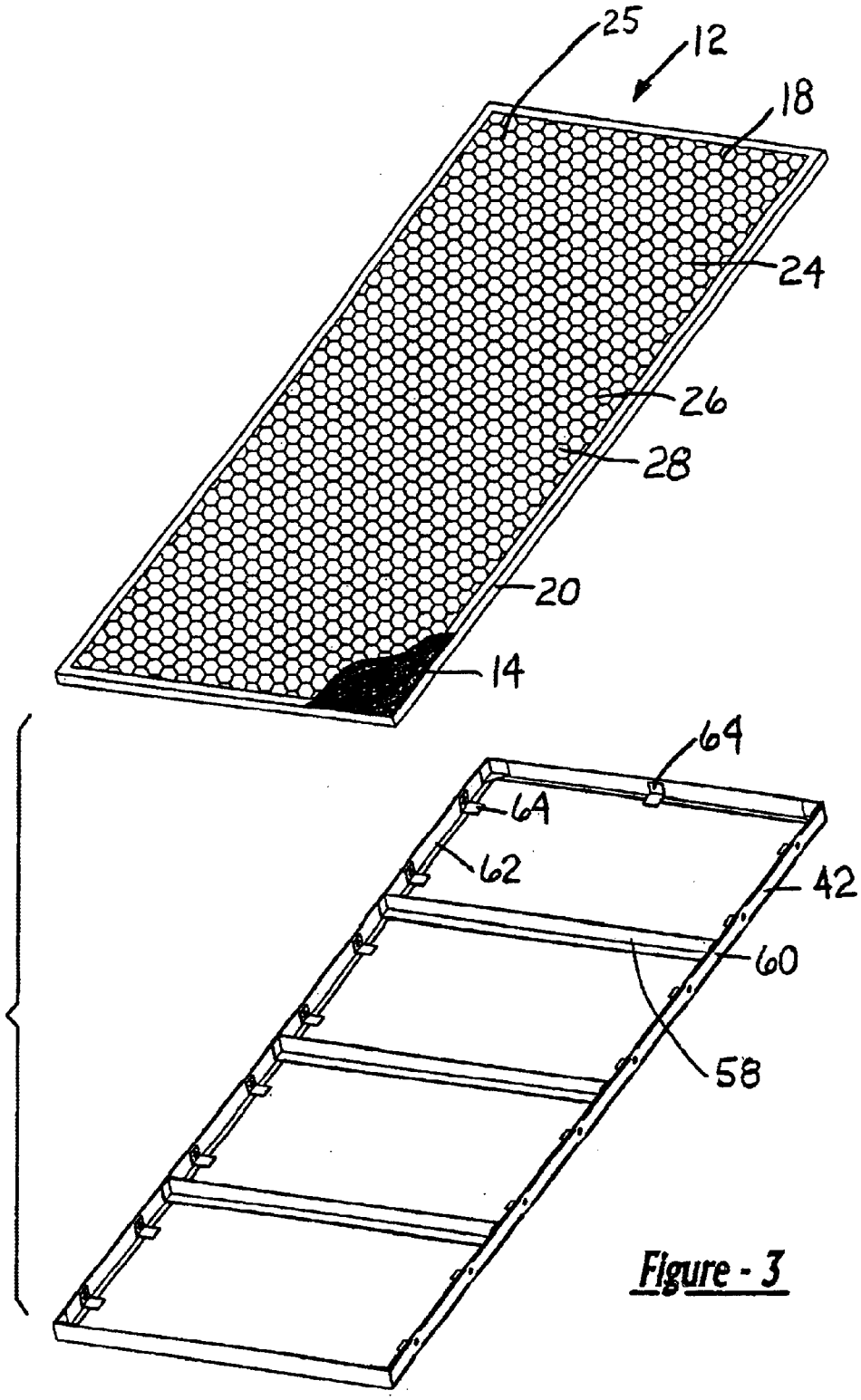
FIG. 3 is a perspective partial view of the construction form system of the present invention with the face sheet of the construction form partially removed to illustrate the honeycomb support material.

FIG. 1 illustrates the construction form 10 of the present invention. Construction form 10 comprises a form sheet 12. Each form sheet 12 includes a face side or face sheet 14, a back side or back sheet 16, a support section 18 defined there between and a connection edge 20. Construction form 10, as shown in FIGS. 1 and 3 includes a face sheet 14 manufactured from a polymeric material 22. Polymeric material, in the present invention, is a polymeric or plastic material such as a fiber reinforced plastic, which does not combine or react with the construction concretes anticipated to be used with the present invention. Other plastics such as polycarbonate, polypropylene and ABS are also contemplated by the present invention.

Figure 6:
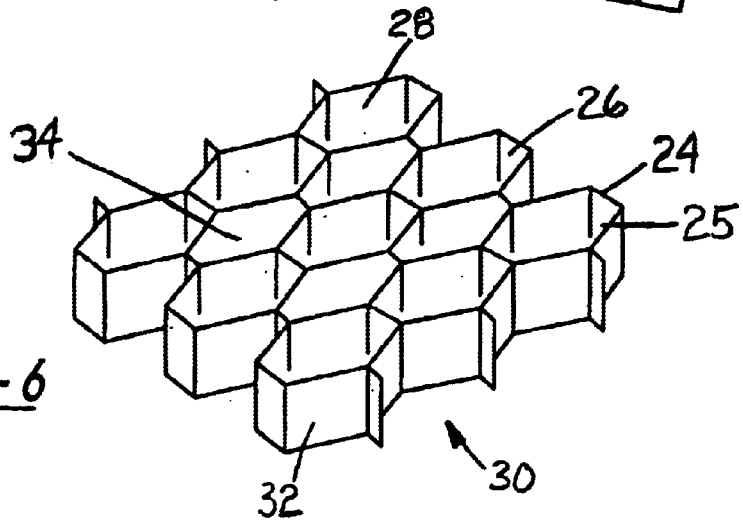
FIG. 6 is a partial perspective view of the honeycomb support material of the construction form system of the present invention.

Back sheet 16 may be manufactured from the same material as the face sheet or from a polymeric or plastic material. The support section 18 is manufactured from a honeycomb support material located between the face sheet 14 and back sheet 16. Referring to FIG. 6, in the best mode of the invention, the honeycomb support material 24, as shown in FIG. 6, is a honeycomb support sheet 25 with a matrix 26 of elongated hexagons 28 forming a pattern 30 of alternating single-walled 32 and double walled cells 34. The honeycomb support material is manufactured from a thermoplastic elastomer in the present invention. The honeycomb support material may also be manufactured from a polypropylene or aluminum. Honeycomb material such as manufactured by Bellcomb and Plascore are contemplated by the present invention.

In the preferred embodiment, the overall thickness of the support section 18, when using the above noted honeycomb support material 24 is in a range from approximately 0.25 inches to 2.0 inches, as measured from the face sheet 14 to the back sheet 16. Other support section wall thicknesses are contemplated by the present invention and the above range is provided using the noted honeycomb material. Different support section materials may require different support section wall thicknesses. The face sheet 14 and back sheet 16 are affixed to the honeycomb support sheet 25 by an adhesive.

As shown in FIG. 1, the form sheet 12 also includes a connection edge 20 disposed substantially along the perimeter of the form sheet 12 as shown in FIGS. 1 and 3. The connection edge is manufactured from a solid polymeric material. The best mode of the present invention utilizes a solid connection edge 20 manufactured from a polymeric or plastic material but other materials such as steel and aluminum are also contemplated by the present invention.

The construction form system 40 includes a side frame 42 for supporting the form sheet 12. The side frame 42 includes a face section 44 and a wall section 46. The face section 44 cooperatively mates with the connection edge 20 of the form sheet 12 to provide a form surface 48. The side frame 42 is manufactured from steel. Other materials such as aluminum, and highly durable plastics are also contemplated by the present invention for the side frame 42. Side frame face section 44 also includes a face side 48 and a support side 50. Form sheet 12 includes a recessed perimeter area 52 adapted to mate with the face side 50 of the side frame 42 such that the face side 48 of the side frame 42 and face side 54 of form sheet 12, when operatively connected, form a flush surface 56. This flush surface is necessary to provide a smooth surface for the forming of the concrete wall.

Referring now to FIG. 3, there is shown ladder 58, extending from a side 60 of side frame 42 to an opposite side 62 of side frame 42. Ladders 58 are utilized to provide support for the construction form. The present invention contemplates the use of three ladders, but any number of ladders may be used depending upon the particular concrete walls being manufactured. Ladders 58 are manufactured from steel. Other materials such as aluminum, and highly durable plastics are also contemplated by the present invention for the ladders 58.

Brackets 64 attached to the side frame 42. The brackets are welded to the side frame in the present invention. The brackets 64 are adapted to support the form sheet 12 in a free floating relationship. More specifically, as shown in FIG. 1, the form sheet 12 is not directly affixed to the side frame 42. The form sheet 12 is positioned is a free floating relationship between the brackets 64 and side frame 42. The form sheet 12 is thus movable is various directions within the confines of the brackets 64 and side frames. Thus in operation, when the construction forms are broken away from the set concrete, the form sheets have some "play" or room to move. This significantly increases the operational life of the form sheet 12 and protect the form sheet from damage in operation.

Figure 2:
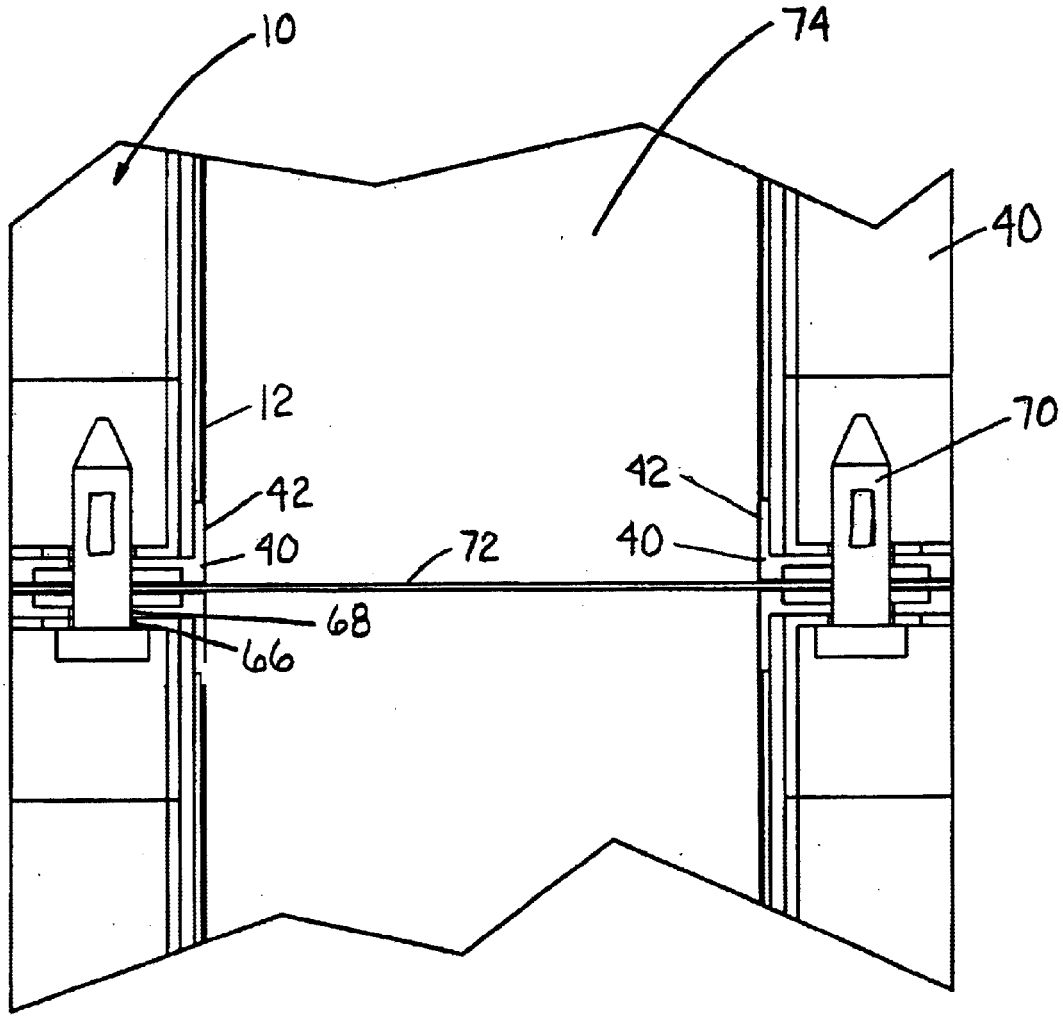
FIG. 2 is a an enlarged cross sectional view of the construction form system of the present invention illustrating one construction form connected to an adjacent construction form.
Figure 4:
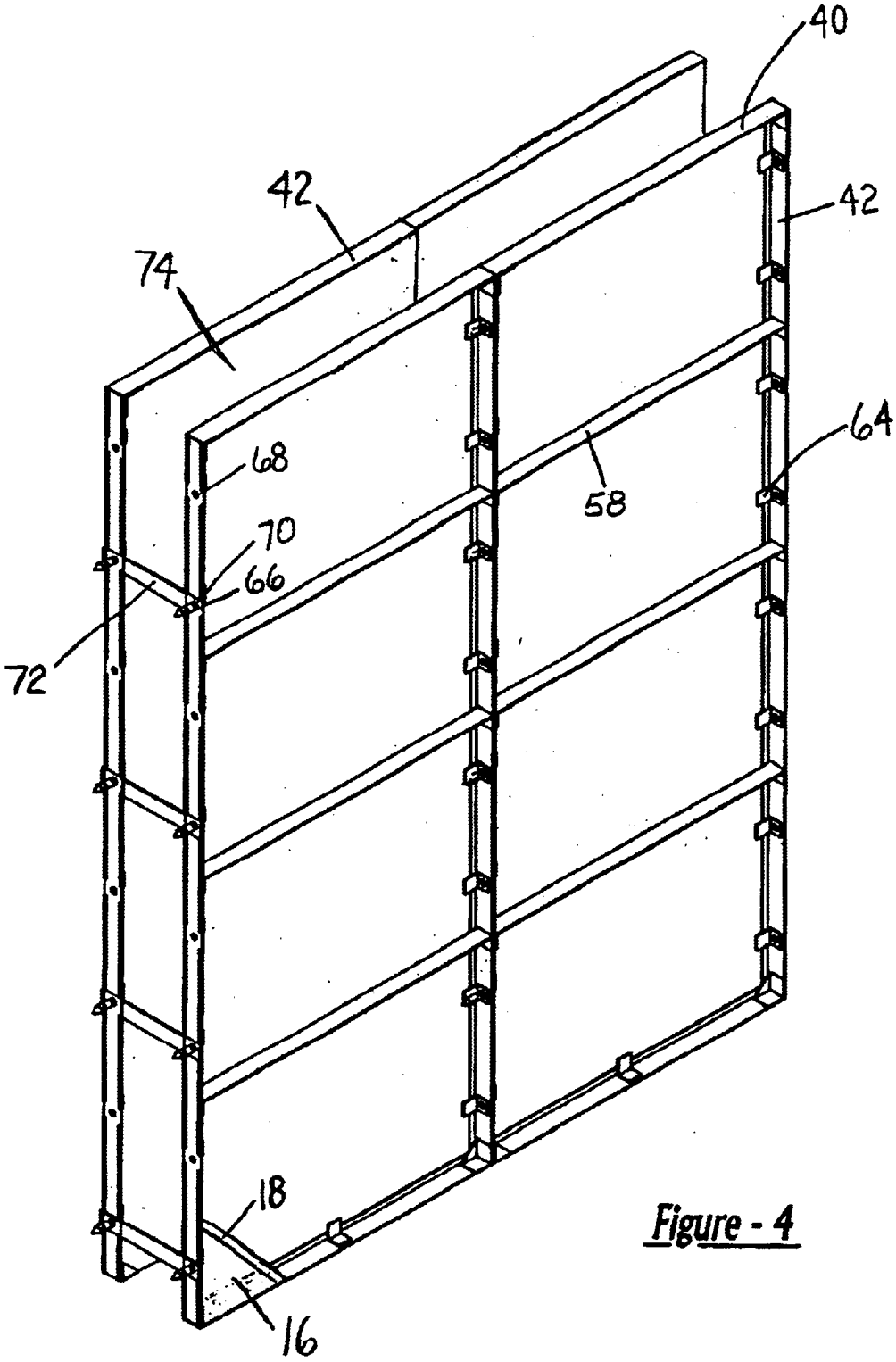
FIG. 4 is a perspective view of the construction frame of the present invention.
Figure 5:
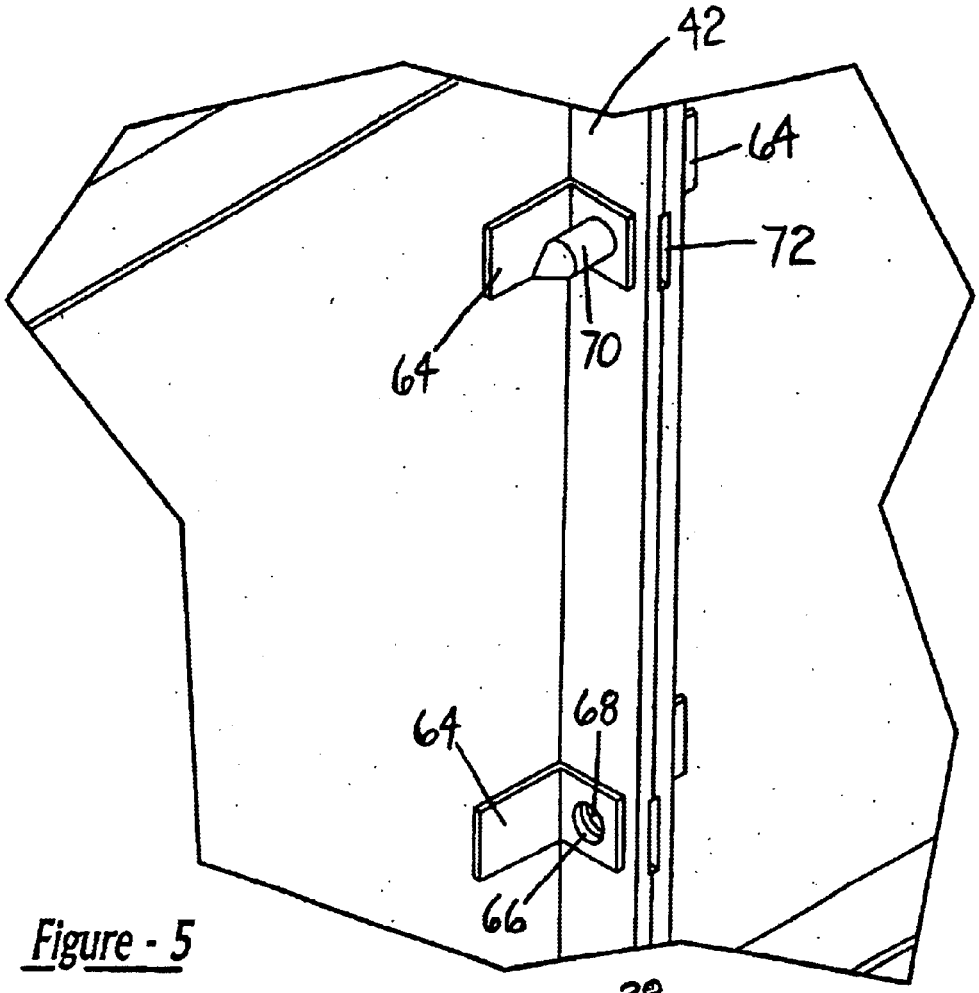
FIG. 5 is an perspective view of the construction form system of the present invention.

As shown in FIGS. 2, 3 and 4, the brackets include a hole 66. Side frame 42 also has defined therein a hole 68 which aligns with the hole of the brackets 66 in operation of the system. Pin 70 is used in conjunction with holes 66 and 68 to connect adjacent side frames together. Connecting bracket 72 is also affixed by pin 70 to connect opposing adjacent side frames together to form the construction form system. The open space 74, defined by the opposing adjacent construction forms is where the poured concrete, not shown, is placed to create the concrete formed wall as is known in the art.

In operation, as shown in FIGS. 2, 3 and 4, the construction form system of the present invention comprises a construction form 10 attached to adjacent construction form 10 by the side rails 42 as noted above. In addition, by use of the connecting bracket 72, opposing construction forms 10 are attached opposite each other. Open space 74, is prepared to accept the poured concrete, not shown, to create the poured wall. The present invention, by its design, provides a construction form which is significantly lighter than present designs. The use of only three to four ladders instead of seven or eight ladders significantly decreases manufacturing time and overall weight. Due the combination of lighter weight and increased structural capability of the honeycomb support material, the present invention allows for wider forms to be used thereby increasing the efficiency of the construction forming process. Wider forms allow for fewer forms for each construction project and also require less time to set in place.

Utilization of the non-corrosive plastic face sheet 16 allows for a longer field use period than present designs. The non-stick properties of the plastic face sheet also does not require the use of forming oil. This eliminates the need for any forming oils or lubricants and improves efficiency while decreasing environmental concerns. The interchangeability of the construction form parts decreases the cost of replacement parts and also allows for a greater degree of flexibility in construction processes. The construction form sheets are interchangeable with any side rail. The free floating capability of the construction form sheet significantly decreases the failure of the construction form during repeated operation. Current practice when dislodging a construction form from a poured wall is to hammer or strike the side rail. In prior art construction forms, this physical contact often fractures or renders unusable the construction form unusable. Thus the free floating form sheet which is not fastened directly to the side frame via any fasteners protects the form sheet from damage in operation.

Figure 7A:
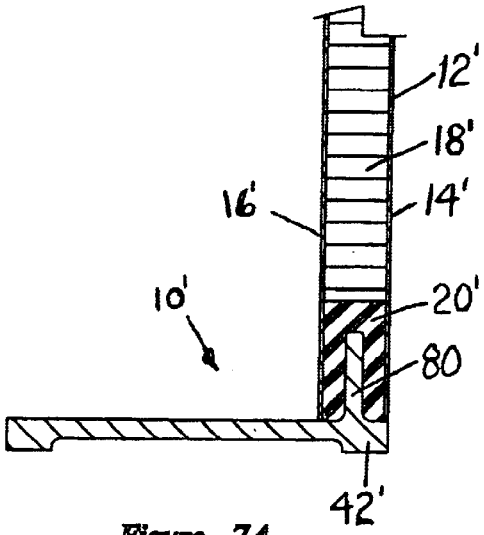
FIG. 7A is a partial cross sectional view of an alternative construction form of the present invention.

FIG. 7A illustrates an alternative construction form 10' of the present invention. Construction form sheet 10' comprises a form sheet 12'. Each form sheet 12' includes a face side or face sheet 14', a back side or back sheet 16', a support section 18' defined there between and a connection edge 20'. Side frame 42' is disposed to support the form sheet 12'. The construction form 10' is identical to the above described construction form 10 except for the connection of connection edge 20' to side frame 42'. As noted in FIG. 7A, side frame includes an extending section 80 which is accepted by the connection edge 20'.

Figure 7B:
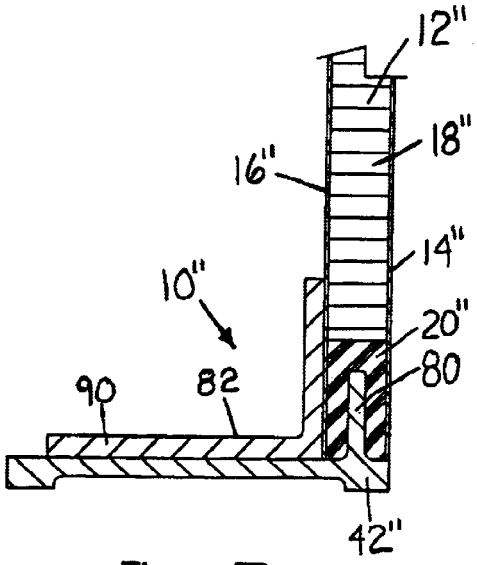
FIG. 7B is a partial cross sectional view of another alternative construction form of the present invention.

FIG. 7B illustrates yet another alternative construction form 10" of the present invention. Construction form sheet 10" comprises a form sheet 12". Each form sheet 12" includes a face side or face sheet 14", a back side or back sheet 16", a support section 18" defined there between and a connection edge 20". Side frame 42" is disposed to support the form sheet 12". The construction form 10" is identical to the above describe construction form 10 except for the connection of connection edge 20' to side frame 42' and the additional support 82. As noted in FIG. 7B, side frame includes an extending section 80 which is accepted by the connection edge 20".

Figure 7C:
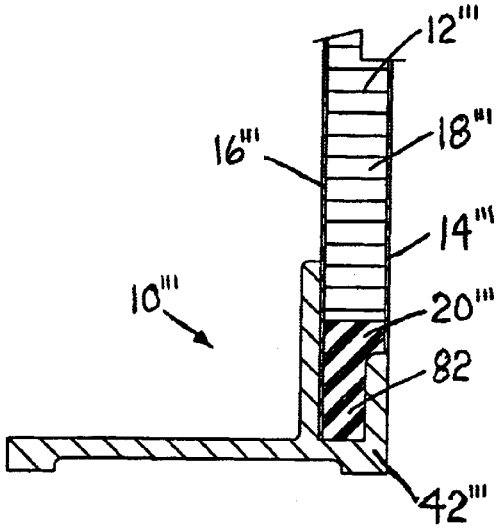
FIG. 7C is a partial cross sectional view of still another alternative construction form of the present invention.

FIG. 7C illustrates still another alternative construction form 10'" of the present invention. Construction form sheet 10'" comprises a form sheet 12'". Each form sheet 12'" includes a face side or face sheet 14'", a back side or back sheet 16'", a support section 18'" defined there between and a connection edge 20'". Side frame 42'" is disposed to support the form sheet 12'". The construction form 10'" is identical to the above describe construction form 10 except for the connection of connection edge 20'" to side frame 42'". As noted in FIG. 7C, connection edge 20'" includes an extending section 82 which is accepted by the side frame 42'".

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A construction form system for manufacturing poured walls, said construction form system comprising:

a plurality of construction forms each including: a composite form sheet having a polymeric face side, a back side and a flexible honeycomb support section defined there between and a solid polymeric connection edge, said solid polymeric connection edge having a recessed perimeter area;

a side frame for supporting said composite form sheet, said side frame having a face section and a wall section, said side frame face section includes a face side and a support side wherein said face section cooperatively mates with said solid polymeric connection edge of said composite form sheet to provide a form surface;

at least one ladder extending from a side of said side frame to an opposite side of said side frame; and a plurality of brackets attached to said side frame adapted to support said composite form sheet and wherein said recessed perimeter area of said solid polymeric connection edge is adapted to cooperatively mate with said face side of said side frame such that said face side of said side frame and face side of said composite form sheet when operatively connected form a flush surface and said composite form sheet is free floating within said side frame to protect the composite form sheet from damage in operation and such that at least one of said brackets is used to connect one side frame of one construction form to another side frame of another construction form.

2. A construction form system as in claim 1 wherein said flexible honeycomb material is manufactured from a thermoplastic elastomer.

3. A construction form system as in claim 1 wherein said flexible honeycomb support material is manufactured from a polypropylene.

4. A construction form for use in manufacturing a poured wall, said construction form comprising:

a composite form sheet having a polymeric face side, a back side and a flexible honeycomb support section defined there between and a solid polymeric connection edge, said solid polymeric connection edge having a recessed perimeter area;

a side frame for supporting said composite form sheet, said side frame having a face section and a wall section, said side frame face section includes a face side and a support side wherein said face section cooperatively mates with said solid polymeric connection edge of said composite form sheet to provide a form surface;

at least one ladder extending from a side of said side frame to an opposite side of said side frame; and a plurality of brackets attached to said side frame adapted to support said composite form sheet and wherein said recessed perimeter area of said solid polymeric connection edge is adapted to cooperatively mate with said face side of said side frame such that said face side of said side frame and face side of said composite form sheet when operatively connected form a flush surface and said composite form sheet is free floating within said side frame to protect the composite form sheet from damage in operation.

5. A construction form as in claim 1 wherein said flexible honeycomb material is manufactured from a thermoplastic elastomer.

6. A construction form as in claim 1 wherein said flexible honeycomb support material is manufactured from a polypropylene.

* * * * *